United States Patent [19]

Johnson et al.

[11] Patent Number: 4,716,665

[45] Date of Patent: Jan. 5, 1988

[54] FOLDING TRENCHER BOOM

[75] Inventors: Richard S. Johnson, Wichita; Stephen A. Youngers, Clearwater, both of Kans.

[73] Assignee: J. I. Case Company, Racine, Wis.

[21] Appl. No.: 5,499

[22] Filed: Jan. 20, 1987

[51] Int. Cl.[4] ..... E02F 5/06

[52] U.S. Cl. ..... 37/86; 37/191 A; 172/75; 172/100

[58] Field of Search ..... 37/80 R, 83, 86, 87, 37/192 A, 192 R, 191 A, 191 R, 142.5; 172/100, 125, 75; 198/313, 632, 854, 861.3; 299/39, 63, 78

[56] References Cited

U.S. PATENT DOCUMENTS

| | | | |
|---|---|---|---|
| 2,995,843 | 8/1961 | Hutchison | 37/86 |
| 3,057,088 | 10/1962 | George et al. | 37/86 |
| 3,309,802 | 3/1967 | Baker | 37/191 R |
| 3,603,010 | 9/1971 | Polinek | 37/83 |

FOREIGN PATENT DOCUMENTS

| | | | |
|---|---|---|---|
| 739791 | 7/1932 | France | 37/191 R |
| 354077 | 8/1931 | United Kingdom | 198/632 |
| 2088930 | 6/1982 | United Kingdom | 37/80 R |

*Primary Examiner*—Charles Pearson
*Assistant Examiner*—Joseph McCarthy
*Attorney, Agent, or Firm*—Cullen, Sloman, Cantor, Grauer, Scott & Rutherford

[57] ABSTRACT

A foldable trencher boom assembly including a first boom portion pivotally connected to a second boom portion by a hinge. One leg of the hinge is connected to the first boom portion while the other leg of the hinge is connected to the second boom portion. When the boom portions are aligned, fasteners secure the hinge to maintain the colinear relationship between the boom portions. In the initial phase of folding, the fasteners are removed thereby permitting the boom portions to pivot relative to each other. The digging boom is conveniently folded by securing the digging chain to one of the foldable boom portions and employing the trencher drive motor as an actuator to achieve the folding action. With the foldable trenching boom of the present invention, an overall decrease in the machine length is attained for transport and maneuverability. Further, when the folded trencher boom is in its transport position, the machine height is decreased and a better distribution of weight is achieved.

3 Claims, 5 Drawing Figures

FOLDING TRENCHER BOOM

BACKGROUND OF THE INVENTION

The present invention relates to a foldable trencher boom assembly which is made in two sections that are hinged together to permit folding for the purpose of decreasing the overall machine length, decreasing the machine height when the trencher boom is in a fully raised transport position, and providing a better distribution of the weight of the boom assembly on the trencher machine.

A conventional trencher machine includes a rearwardly projecting digging boom which is connected to the trencher for pivotal movement in a cantilevered fashion. Transporting conventional digging booms is awkward since these booms substantially increase the overall machine length and height when the digging boom is in its fully raised transport position. Further, since the digging boom is cantilevered, the center of gravity for the trencher machine is higher when the digging boom is in a raised transport position.

Thus, there has been a need for a trencher boom assembly that provides a decrease in overall machine length and height when the trencher boom is in its fully raised transport position and provides for a better distribution of the weight of the boom assembly on the trencher machine.

SUMMARY OF THE INVENTION

The foldable trencher boom assembly of the present invention includes a foldable boom having a first portion pivotally connected to a second portion by a hinge means. One leg of the hinge means is connected to the first boom portion while the other leg of the hinge means is connected to the second boom portion. When the boom portions are colinearly aligned, fasteners secure the hinge leg on the second boom portion to the first boom portion thereby maintaining the colinear relationship. Further, the hinge pin for the hinge means is located above the centerline of the boom when the first and second boom portions are aligned to permit folding of the boom portions relative to each other.

The foldable trencher boom assembly is conventionally mounted for pivotal movement to a trenching machine frame. The first boom portion includes a motor driven sprocket and an auger for dispersing the soil which is dug during the trenching operation to the sides of the trench. The trencher boom assembly also includes a conventional digging chain which is engaged along its length by the motor driven sprocket.

The trencher boom assembly is lowered to the ground during the initial phase of the folding operation and the fasteners connecting the boom portions are removed thereby permitting one boom portion to pivot relative to the other boom portion about the hinge pin. In this position, the second boom portion is supported in a generally parallel position relative to the ground. A chain is then secured around the top span of the digging chain and second boom portion. After the digging chain is secured to the boom portion, the drive sprocket is rotated by the conventional trencher drive motor thereby causing the chain to shift along the boom portion until it engages a hook. Continued driving of the sprocket results in the raising of the second boom portion relative to the first boom portion.

Mounting structure is provided on the trencher boom assembly which includes opposed, spaced apart plates with aligned pairs of openings. A crossbar is placed within one of the pairs of openings to support the second boom portion when it rotates overcenter into a fully folded position. Another crossbar may be used in the other pair of openings to secure the boom portion in the folded position for purposes of transport or the like. The trencher boom assembly can be maneuvered from a folded position into a work position by performing these steps in reverse.

Thus, the present invention provides a trencher digging boom which may be conveniently folded by securing the digging chain to one of the foldable boom portions and employing the conventional trencher drive motor as an actuator to achieve the folding action. This results in fewer and substantially less expensive parts to cause the folding of the boom portions. With the foldable trencher boom, an overall decrease in the machine length and height is possible for transport and maneuverability. Further, when the folded trencher boom is in its transport position, a better distribution of weight is achieved as compared to conventional trencher boom constructions.

Other advantages and meritorious features of the foldable trencher boom assembly will be more fully understood from the following description of the invention, and appended claims, and the drawings, a brief description of which follows.

DESCRIPTION OF THE INVENTION

Figure 5:
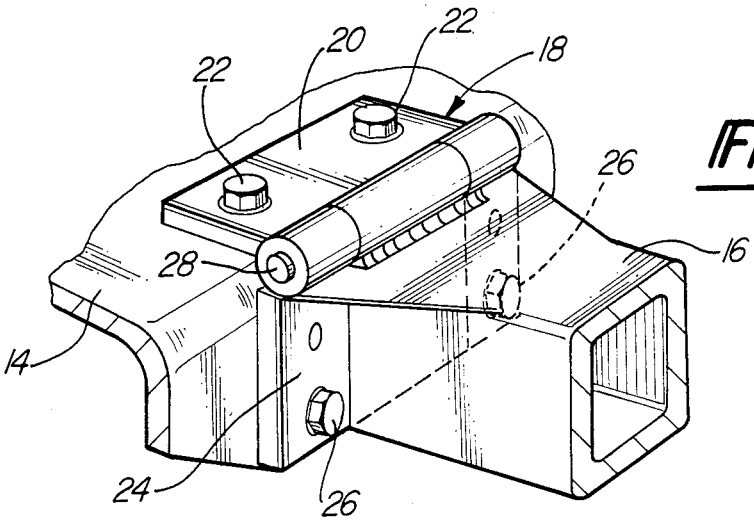
FIG. 5 is a perspective view of the hinge connection between the foldable boom portions.

The foldable trencher boom assembly of the present invention is illustrated in FIGS. 1–5. Trencher boom assembly 10 includes a foldable boom 12 having a first portion 14 pivotally connected to a second portion 16 by hinge means 18. Referring to FIG. 5, one leg 20 of hinge 18 is connected by fasteners 22 to boom portion 14 while the other leg 24 of hinge 18 is connected to boom portion 16. When boom portions 14 and 16 are colinearly aligned as shown in FIG. 5, fasteners 26 secure hinge leg 24 to boom portion 14 to maintain the colinear relationship. Further, the pivot or hinge pin 28 for hinge 18 is located above the centerline of the boom 12 when portions 14 and 16 are aligned to permit folding of the boom portions 14 and 16 relative to each other as will be described.

Digging boom 12 is conventionally mounted for pivotal movement to a trenching machine frame 30, which is only partially shown in FIGS. 1–4. Boom portion 14 includes a motor driven sprocket 32 and an auger 34 for dispersing the soil which is dug during the trenching operation to the sides of the trench. Further, a crumber (not shown) is attached at the mounting structure 36 on boom 12 for the purpose of cleaning the bottom of the trench during the digging operation, as is conventional. The trencher boom assembly 10 also includes a conventional digging chain 38 which is engaged along its length by sprockets 40, 42, 44, and by motor driven sprocket 32.

Figure 1:
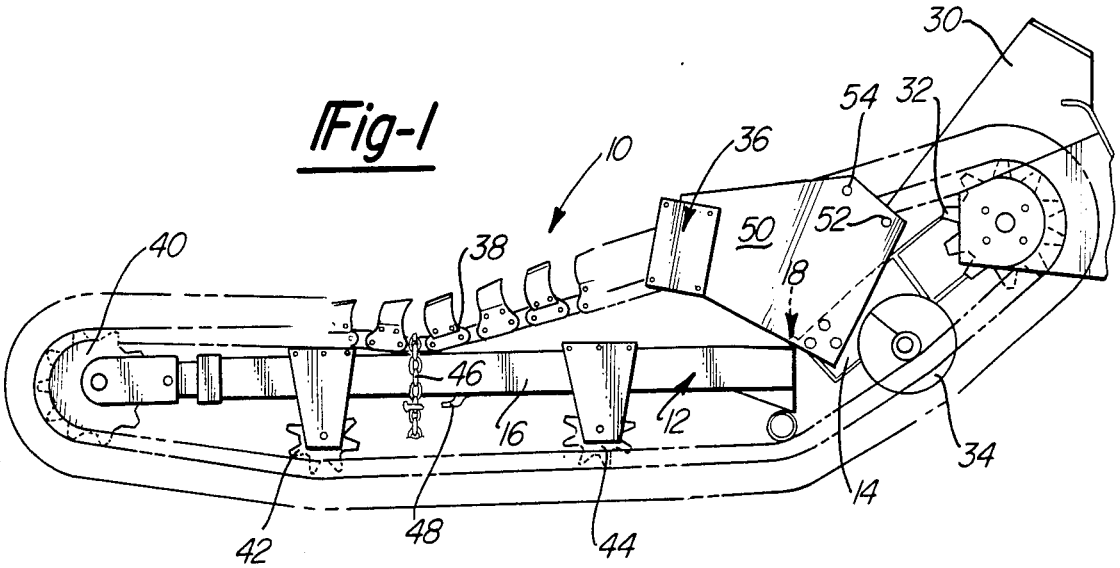
FIG. 1 is a side elevational view of the foldable trencher boom assembly in the initial phase of folding wherein the boom has been lowered to the ground and the fasteners connecting the boom portions have been removed.

Referring now to FIGS. 1–4, the method of folding trencher boom assembly 10 will now be described. FIG. 1 illustrates the trencher assembly 10 in the initial phase of folding wherein boom 12 has been lowered to the ground and the fasteners 26 have been removed thereby permitting boom portion 16 to pivot relative to boom portion 14 about hinge pin 28. As shown in FIG. 1, the trencher assembly 10 is initially lowered such that boom portion 16 is supported in a generally parallel position relative to the ground. A chain 46 is then secured around the top span of digging chain 38 and boom portion 16.

Figure 2:
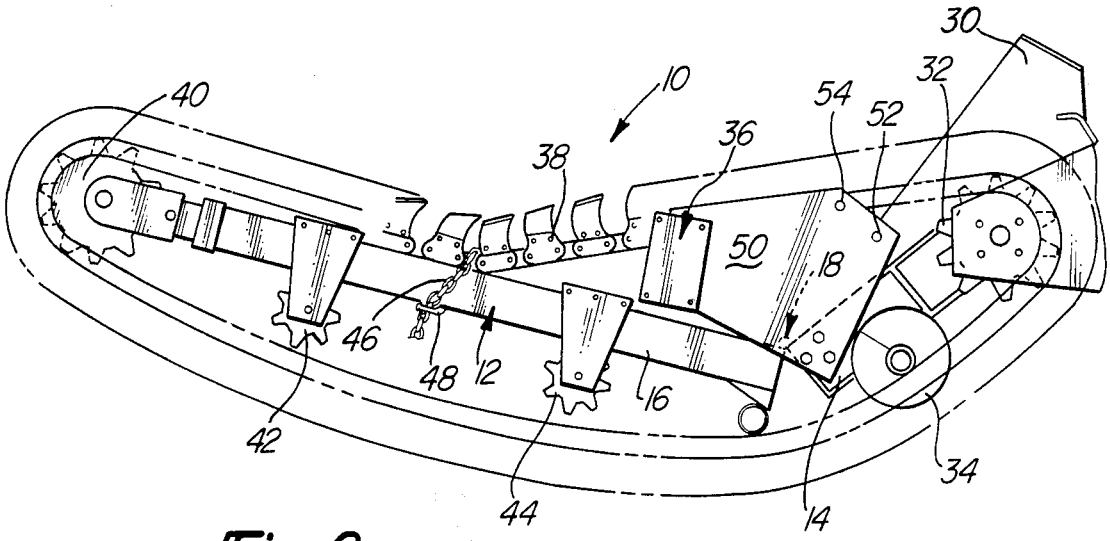
FIG. 2 is a side elevational view of the foldable trencher boom assembly illustrating the shifting of the attachment chain along the boom portion until it engages a hook thereby resulting in the raising of the boom portion.
Figure 3:
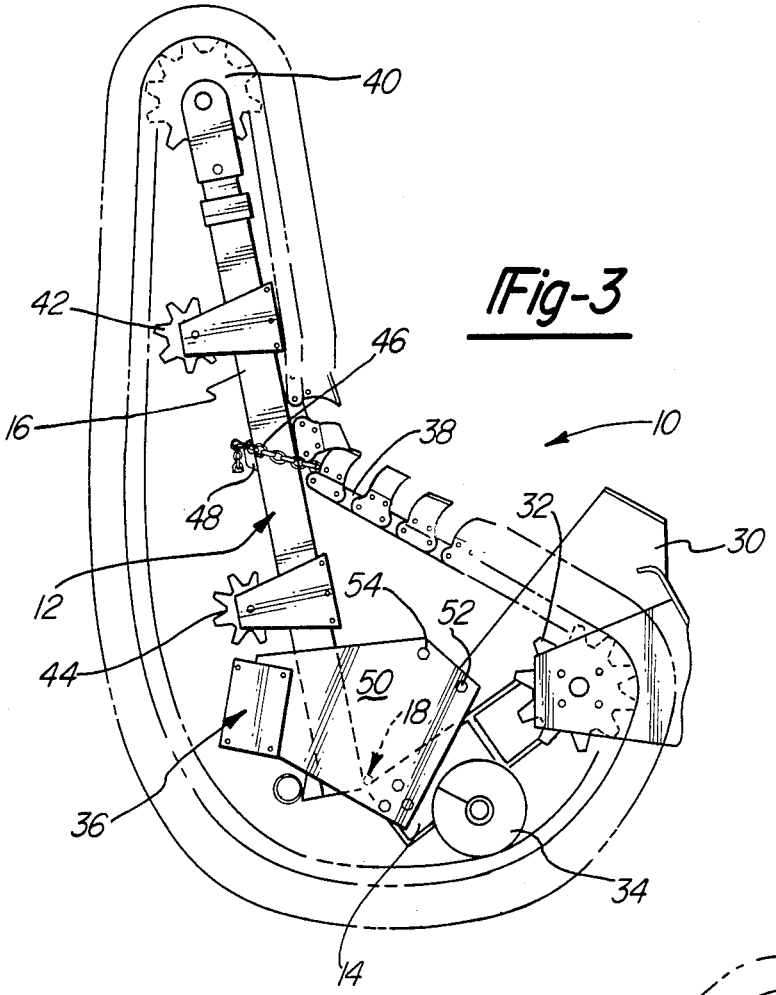
FIG. 3 is a side elevational view of the trencher boom assembly illustrating the raising of the boom portion toward an overcenter position.

After digging chain 38 is secured to boom portion 16 by chain 46, sprocket 32 is rotated by the conventional trencher drive motor (not shown) thereby causing chain 46 to shift along boom portion 16 until it engages hook 48 as shown in FIG. 2. At this point, continued driving of sprocket 32 results in the raising of boom portion 16 as illustrated in FIG. 3.

Figure 4:
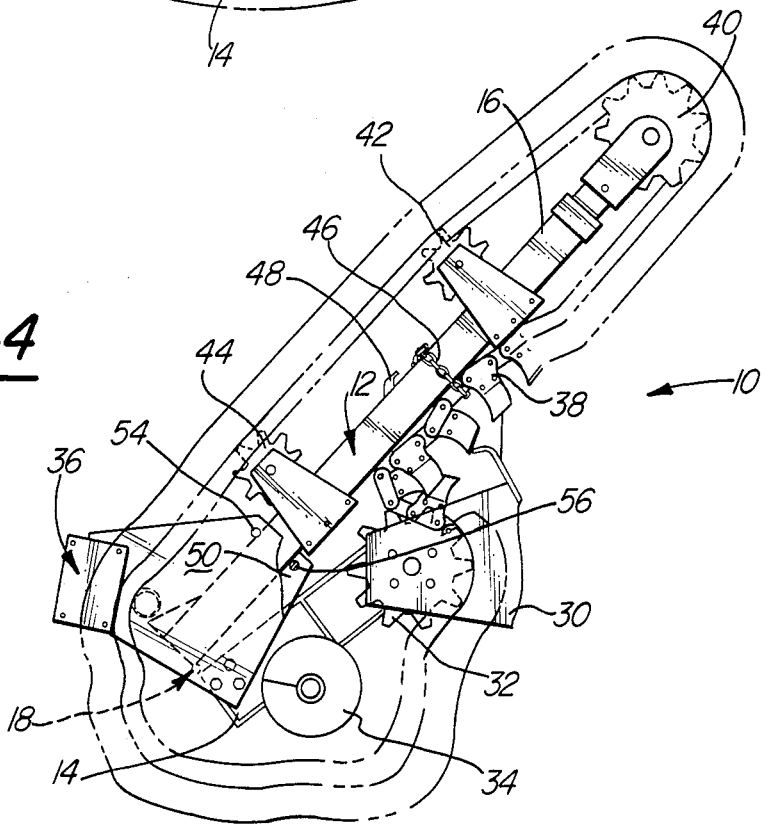
FIG. 4 is a side elevational view of the trencher boom assembly illustrating a fully folded position.

Mounting structure 36 includes opposed spaced apart plates 50 with aligned pairs of openings 52 and 54. A crossbar 56 (FIG. 4) is placed within one of the pairs of openings 52 to support boom portion 16 when it rotates overcenter into a fully folded position as shown in FIG. 4. Another crossbar may be used in the other pair of openings 54 to secure boom portion 16 in the folded position for purposes of transport or the like. The excess digging chain may then be tucked into the open area under boom 12. Further, the trencher boom 12 can be maneuvered from a folded position into a work position by performing the above described steps in reverse.

Thus, the present invention provides a trencher digging boom which may be conveniently folded by securing the digging chain 38 to one of the foldable boom portions 14, 16 and employing the conventional trencher drive motor as an actuator to achieve the folding action. This results in fewer and substantially less expensive parts to cause the folding of the boom portions 14 and 16. With a foldable trencher boom 12, an overall decrease in machine length is possible for transport and maneuverability. Further, when the folded trencher boom 12 is in a transport position as shown in FIG. 4, the machine height is decreased and a better distribution of weight is achieved as compared to conventional trencher boom constructions.

It will be apparent to those skilled in the art that the foregoing disclosure is exemplary in nature rather than limiting, the invention being defined by the appended claims.

We claim:

1. A digging boom assembly comprising:

a first boom portion pivotally connected to a second boom portion by a hinge means, said hinge means including a first leg, a second leg, and a hinge pin connecting said first and second legs, and releasable fastening means for securing one of said legs to one of said boom portions such that said boom portions may be moved from a first position wherein the boom portions are colinearly aligned and said fastening means are engaged to a second position wherein said fastening means are released and the boom portions are folded relative to each other;

2. The digging boom assembly as defined in claim 10 wherein said first boom portion includes support means upon which said second boom portion rests when said second boom portion is folded toward said first boom portion.

3. The method of folding a trencher boom assembly including a rotatable digging chain comprising the steps of:

(a) releasably securing a first boom portion to a second boom portion such that the boom portions may be folded from a colinear relationship toward each other;

(b) releasing said securing relationship to enable said boom portion to be moved from said colinear relationship;

(c) releasably securing the digging chain to one of the boom portions; and (d) folding said one boom portion toward the other boom portion in response to rotation of said digging chain.

a digging chain operably connected to said boom portions for rotation relative thereto; and means to cause folding of said one boom portion toward the other boom portion including means for temporarily attaching said digging chain to one of said boom portions, said temporary attaching means including a stop on said one boom portion and a flexible member loosely connecting said digging chain to said one boom portion, said flexible member being slidable along said one boom portion in response to rotation of said digging chain for engaging said stop thereby causing folding of said one boom portion toward the other boom portion responsive to the combination of release of said fastening means and continued rotation of said digging chain after said temporary attaching means engages said stop.

* * * * *

UNITED STATES PATENT AND TRADEMARK OFFICE

CERTIFICATE OF CORRECTION

PATENT NO. : 4,716,665

DATED : January 5, 1988

INVENTOR(S) : Richard S. Johnson and Stephen A. Youngers

It is certified that error appears in the above-identified patent and that said Letters Patent is hereby corrected as shown below:

Please list the claims in the following order:

1. A digging boom assembly comprising:

a first boom portion pivotally connected to a second boom portion by a hinge means, said hinge means including a first leg, a second leg, and a hinge pin connecting said first and second legs, and releasable fastening means for securing one of said legs to one of said boom portions such that said boom portions may be moved from a first position wherein the boom portions are colinearly aligned and said fastening means are engaged to a second position wherein said fastening means are released and the boom portions are folded relative to each other;

a digging chain operably connected to said boom portions for rotation relative thereto; and means to cause folding of said one boom portion toward the other boom portion including means for temporarily attaching said digging chain to one of said boom portions, said temporary attaching means including a stop on said one boom portion and a flexible member loosely connecting said digging chain to said one boom portion, said flexible member being slidable along said one boom portion in response to rotation of said digging chain for engaging said stop thereby causing folding of said one boom portion toward the other boom portion responsive to the combination of release of said fastening means and continued rotation of said digging chain after said temporary attaching means engages said stop.

2. The digging boom assembly as defined in claim 1 wherein said first boom portion includes support means upon which said second boom portion rests when said second boom portion is folded toward said first boom portion.

UNITED STATES PATENT AND TRADEMARK OFFICE

CERTIFICATE OF CORRECTION

PATENT NO. : 4,716,665

DATED : January 5, 1988

INVENTOR(S) : Richard S. Johnson and Stephen A. Youngers

It is certified that error appears in the above-identified patent and that said Letters Patent is hereby corrected as shown below:

3. The method of folding a trencher boom assembly including a rotatable digging chain comprising the steps of:

(a) releasably securing a first boom portion to a second boom portion such that the boom portions may be folded from a colinear relationship toward each other;

(b) releasing said securing relationship to enable said boom portion to be moved from said colinear relationship;

(c) releasably securing the digging chain to one of the boom portions; and (d) folding said one boom portion toward the other boom portion in response to rotation of said digging chain.

Signed and Sealed this

Fourth Day of October, 1988

*Attest:*

*Attesting Officer*

DONALD J. QUIGG

*Commissioner of Patents and Trademarks*